United States Patent [19]

Mizukawa

[11] 4,014,101

[45] Mar. 29, 1977

[54] ELLIPSE DRAWING INSTRUMENT

[75] Inventor: Suehiro Mizukawa, Shijonawate, Japan

[73] Assignee: Shinichi Yamaoka, Japan

[22] Filed: Nov. 24, 1975

[21] Appl. No.: 634,734

[30] Foreign Application Priority Data

Dec. 4, 1974 Japan ..... 49-141294

[52] U.S. Cl. ..... 33/30 R; 33/31

[51] Int. Cl.[2] ..... B43L 11/04

[58] Field of Search ..... 33/30 R, 30 D, 30 G, 33/31

[56] References Cited

UNITED STATES PATENTS

| | | | |
|---|---|---|---|
| 2,415,283 | 2/1947 | Hobson | 33/30 A |
| 3,500,544 | 3/1970 | Hill | 33/30 D |
| 3,724,080 | 4/1973 | Kane | 33/30 D |

FOREIGN PATENTS OR APPLICATIONS

| | | | |
|---|---|---|---|
| 147,323 | 10/1962 | U.S.S.R. | 33/31 |

*Primary Examiner*—Harry N. Haroian
*Assistant Examiner*—John W. Shepperd
*Attorney, Agent, or Firm*—Wenderoth, Lind & Ponack

[57] ABSTRACT

An ellipse drawing instrument which makes it possible to draw an ellipse easily and precisely without requiring special skill. The size and angle of the ellipse can be changed steplessly by a simple adjustment. It includes a base plate, a movable plate, a swivel arm, a swaying lever coupled to the movable plate and the swivel arm, and a writing implement carriage coupled to the movable plate and the swaying lever. When the swivel arm is turned, the writing implement carriage is given movements in two directions which are synthesized into an elliptical motion with respect to the material on which the ellipse is to be drawn.

1 Claim, 5 Drawing Figures

ELLIPSE DRAWING INSTRUMENT

BACKGROUND OF THE INVENTION

The present invention relates to an ellipse drawing instrument with which ellipses of varying size and angle can be drawn accurately and efficiently.

The necessity of drawing ellipses often arises in drafting drawings, illustrations or the like. Conventionally, ellipses have been drawn either by use of a set of ellipse rules made by punching ellipses in thin plates or by use of a rule and a pair of compasses.

Ellipse rules, the edge of which is traced with a writing implement to draw ellipses, provide a handy tool, but have several shortcomings. Since a lot of rules have to be kept on hand to cover ellipses of different sizes and angles, this method entails a considerable cost. Also, even if a complete set of rules is purchased, only a limited number of ellipses can be drawn since such rules differ in size and angle in a steplike manner.

The other method using compasses and ordinary rules requires considerable skill or technique and takes much time because the ratio between the lengths of the major and minor axes has to be calculated for each ellipse.

BRIEF SUMMARY OF INVENTION

In order to surmount these disadvantages, it is an object of the present invention to provide an ellipse drawing instrument capable of drawing an ellipse of any desired size and angle easily and accurately without requiring any special skill or technique.

It is another object of the present invention to provide an ellipse drawing instrument on which the size and angle of an ellipse to be drawn can be changed in a stepless manner by simple adjustment.

It is a further object of the present invention to provide an ellipse drawing instrument which permits easy and precise division of the ellipse that has been drawn.

Other objects and features of the present invention will become apparent from the following description with reference to the accompanying drawings.

DETAILED DESCRIPTION

Figure 1:
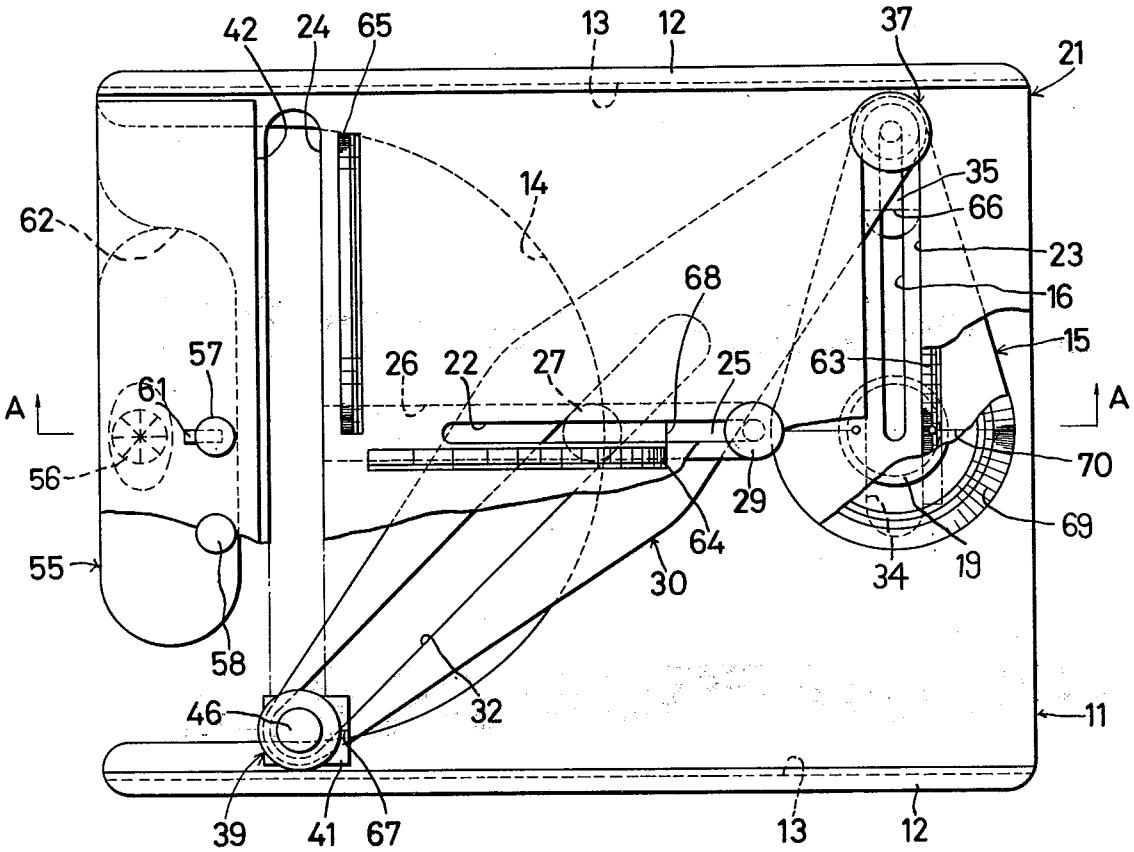
FIG. 1 is a partially cutaway plan view of an ellipse drawing instrument according to the present invention.

Referring to FIG. 1, a rectangular base plate 11 of synthetic resin is fixed in place on a piece of paper or like surface on which it is desired to draw an ellipse. The base plate 11 includes an opposed pair of upwardly extending side walls 12 extending along its longitudinal edges, said walls each being provided with a horizontal guide groove 13 in the inner face thereof. The base plate 11 also has a semi-circular notch 14 extending from one end thereof to about midway of its length.

On the base plate 11 is mounted a swivel arm 15 adjacent to the right-hand end thereof in FIG. 1 for swivel movement in a horizontal plane. The swivel arm 15 has a circular base portion and becomes narrower as it approaches its tip. It has a longitudinal slit 16 formed therein, said slit extending from the base portion toward the tip.

Figure 2:
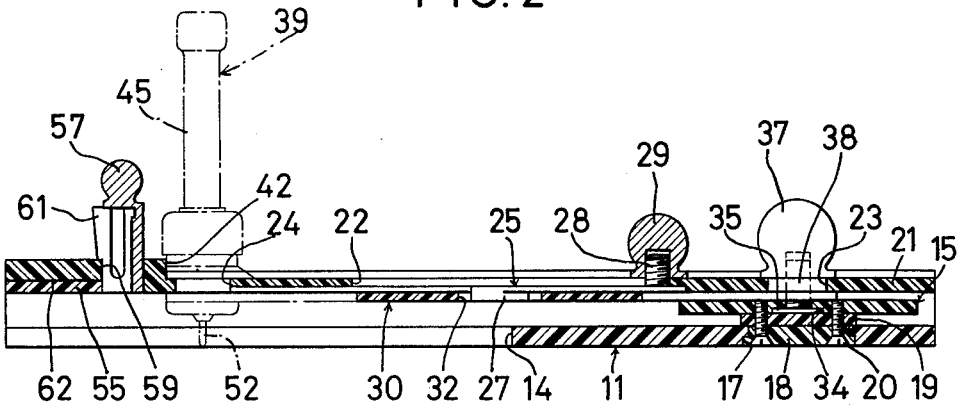
FIG. 2 is a cross-sectional view thereof taken on line A—A in FIG. 1.
Figure 4:
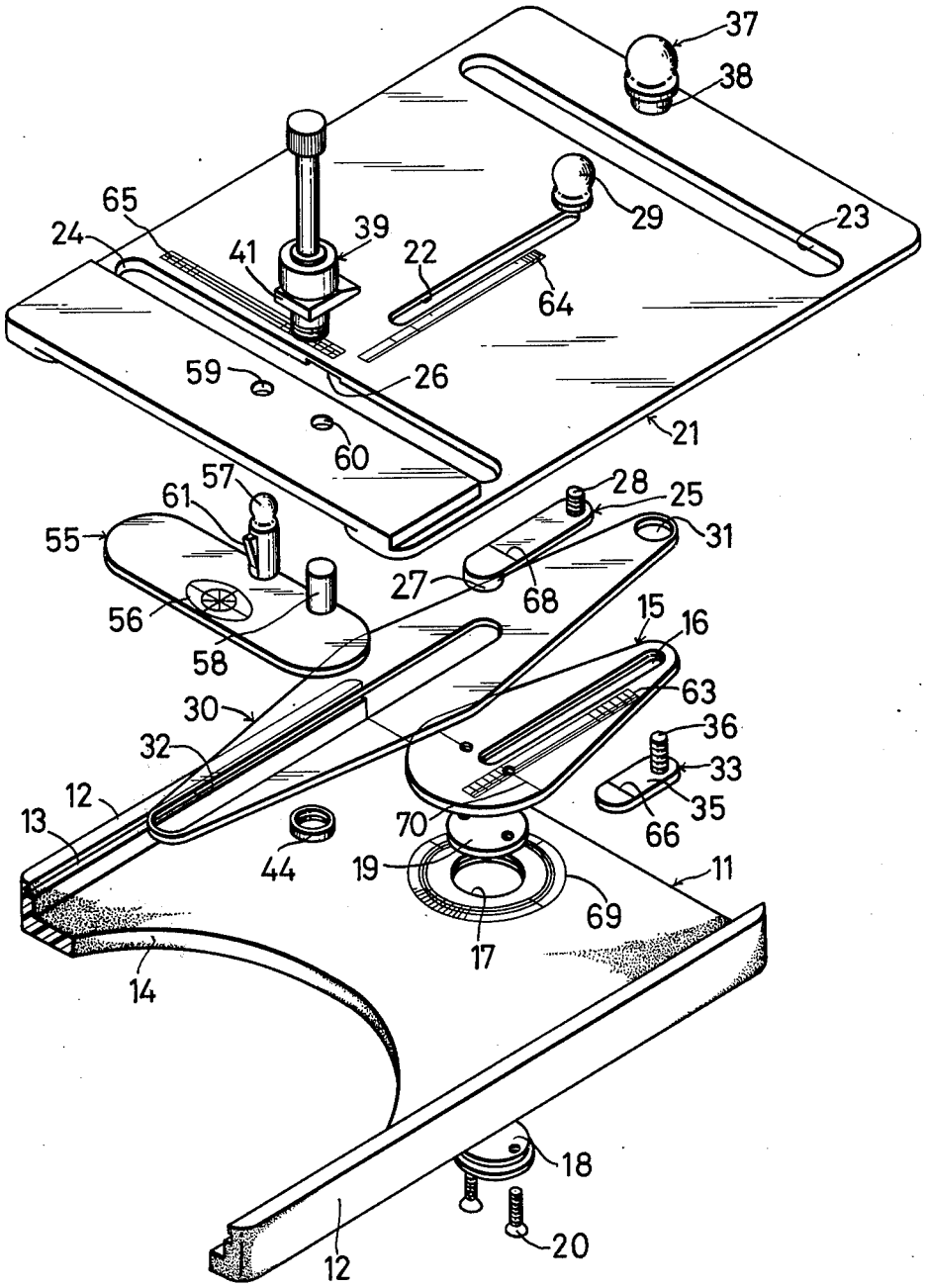
FIG. 4 is an exploded perspective view thereof.

The swivel arm 15 is made of a transparent synthetic resin material. It is mounted on the base plate 11 as shown in FIGS. 2 and 4. In the base plate 11 is formed a stepped hole 17 with a lower step of a larger diameter into which a stepped turnplate 18 of corresponding shape is rotatably fitted from beneath so as not to come upwardly through the stepped hole 17. On the turnplate 18 is coaxially mounted a disc 19 of a slightly larger diameter than that of the stepped hole 17 at its upper edge. The base portion of the swivel arm 15 is placed coaxially on the disc 19 and the turnplate 18, disc 19 and swivel arm 15 are secured to one another by screws 20. The lower surface of the swivel arm 15 lies above the base plate 11 by the thickness of the disc 19 for free swiveling around its base portion.

A rectangular movable plate 21 of substantially the same size as the base plate 11 is supported on the base plate 11 with its longitudinal edges fitted in the guide grooves 13 in the side walls 12 of the base plate 11 for longitudinal displacement in a horizontal plane above the swivel arm 15. The movable plate 21, too, is transparent and is made of synthetic resin material. The movable plate 21 has a longitudinal slit 22 formed in the center of its width and an opposed pair of transverse slits 23 and 24 formed at each end thereof in a direction perpendicular to the slit 22.

The transverse slits 23 and 24 are parallel to each other and are long enough for their ends to be adjacent to the longitudinal edges of the movable plate 21. The longitudinal slit 22 is aligned with the swivel center for the swivel arm 15.

On the underside of the movable plate 21 is mounted a fulcrum member 25, the position of which is adjustable along the longitudinal slit 22. The fulcrum member 25 is a short rod slidably fitted in a recess 26 formed in the underside of the movable plate 21 under and along the longitudinal slit 22, said recess being wider than the latter. The fulcrum member 25 comprises a stud-like fulcrum 27 projecting downwardly at one end thereof, and a threaded shaft 28 projecting upwardly from the other end and passing through the longitudinal slit 22. A knob 29 is screwed on the threaded shaft 28 to secure the fulcrum member 25 to the movable plate 21.

The fulcrum member 25 has its fulcrum 27 disposed at its lefthand end in FIG. 1, the position of the fulcrum being adjustable over the whole length of the slit 22.

Under the movable plate 21 is arranged a swaying lever 30 to be swayable around the fulcrum 27 and movable in a longitudinal direction along its own axis. The swaying lever 30 is longer than the distance between the two transverse slits 23 and 24 and is of such a thickness as to be movable between the movable plate 21 and the swivel arm 15.

The swaying lever 30 has a hole 31 at one end thereof and a longitudinal slit 32 extending from the other end thereof to midway of its length. With the fulcrum 27 fitted in the longitudinal slit 32, the swaying lever 30 is movable relative to the movable plate 21 over the whole length of the slit 32.

The movable plate 21, swaying lever 30 and swivel arm 15 are coupled to one another by an adjusting member 33 which is received in a recess 34 formed in the underside of the swivel arm 15 under and along the slit 16. The adjusting member 33 comprises a plate member 35 from one end of which projects upwardly a threaded shaft 36 which passes through the slit 16 in the swivel arm 15, the hole 31 in the swaying lever 30, and the transverse slit 23 in the movable plate 21. A knob 37 is tightened on the threaded shaft 36 projecting beyond the movable plate 21 to couple these three members together.

The adjusting member 33 serves to determine the length of major axis of an ellipse to be drawn. The knob 37 is provided with a stud 38 of smaller diameter which loosely fits in the transverse slit 23 and the hole 31. When tightened, the knob 37 secures the adjusting member 33 to the swivel arm 15 with the latter clamped between the bottom of the stud 38 and the plate member 35.

This arrangement ensures that when the swivel arm 15 is given a full turn by means of the knob 37, the movable plate 21 moves forward and backward along the guide groove 13 in a longitudinal direction a distance equal to twice the distance from the center of base portion of the swivel arm 15 to that of the knob 37.

The swaying lever 30 makes a circular motion at the end pivoted to arm 15 while it sways around the fulcrum 27 and moves in a direction along its axis, guided by the slit 32.

In the other slit 24 in the movable plate 21 is mounted a writing implement carriage 39 so as to be freely slidable therealong. The writing implement carriage 39 has a cylindrical member 40 at its bottom slidably received in the slit 32 in the swaying lever 30. Thus, when the swivel arm 15 is turned by means of the knob 37, the writing implement carriage 39 moves along the slits 24 and 32, always lying at the intersection thereof. In other words, it moves laterally along the slit 24 through swaying motion of the swaying lever 30 while moving in a longitudinal direction with the movable plate 21. A synthesis of these movements in two directions results in an elliptical motion relative to the base plate 11.

The depth of the semi-circular notch 14 is determined by the maximum stroke of the movable plate 21 so that such an elliptical movement will always be given to the writing implement within the notch 14.

Figure 3:
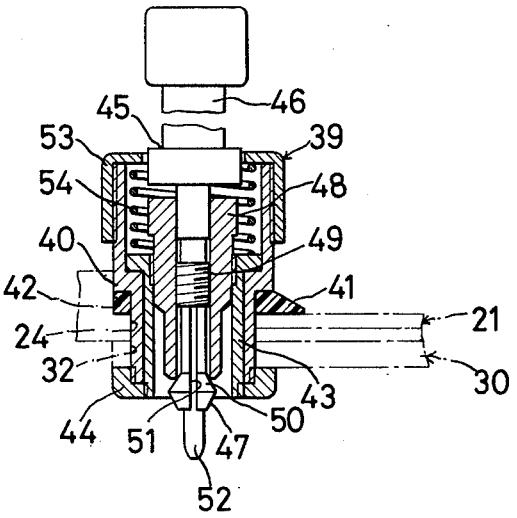
FIG. 3 is an enlarged vertical cross-sectional view of the writing implement carriage thereof.

The construction of the writing implement carriage 39 is shown in FIG. 3 by way of example. A rectangular slide plate 41 is fixedly mounted on the cylindrical member 40 with its upper edge butting against a shoulder formed thereon so as to slide on the upper surface of the movable plate 21. The slide plate 41 has its outer edge in slidable contact with the side of a raised portion 42 provided on the movable plate 21 along the slit 24 at its lefthand end in FIG. 1. This arrangement insures that the writing implement carriage 39 moves along the slit 24 without turning.

In the cylindrical member 40 is mounted an inner tube 43 with a flange at its top resting on the inner shoulder thereof. A nut member 44 is screwed on the cylindrical member 40 from below to prevent it from coming off the swaying lever 30.

In the cylindrical member 40 is also mounted a holder 45 which comprises a tubular body 46, a chuck 47 disposed below the body 46, and a threaded tube 48 rotatably mounted on a male screw 49 provided on the chuck 47 intermediately of its length.

The threaded tube 48 is screwed in the inner tube 43 to mount the holder 45 in the cylindrical member 40. The chuck 47 is provided with a thicker portion with a tapered face 50 at its bottom projecting downwardly out of the threaded tube 48 and is split into a plurality of portions separated by cuts 51 below the male screw 49.

A writing material 52 such as a pencil lead is inserted into the chuck 47 through the tubular body 46. When the tubular body 46 is manually turned to raise the chuck 47, the split portions are closed together to clamp the writing material 52 because the thicker portion is hindered in its upward movement by the lower end of the threaded tube 48. When the chuck 47 is lowered, the thicker portion spreads itself to release the writing material 52. By turning the tubular body 46, the distance which the writing material 52 projects downwardly can thus be so adjusted that its tip comes in contact with the paper on which the base plate 11 is placed.

Between a nut member 53 screwed on top of the cylindrical member 40 and the inner tube 43 is compressed a spring 54 to bias the writing material 52 against the paper with a suitable pressure.

In the preferred embodiment, a pencil lead is used as writing material 52, but this is not the only material which can be used. A drawing pen, lettering pen, ballpoint pen and the like may be used.

A positioning member 55 for determining the center of an ellipse is mounted on the movable plate 21 at its lefthand end on the underside thereof. The positioning member 55 is an oblong transparent plate with arcuate ends, having a center mark 56 thereon.

From the upper surface of the positioning member 55 project two studs 57 and 58, one in the center and the other slightly off the center, along one longitudinal edge thereof. The positioning member 55 is mounted under the movable plate 21 with the studs 57 and 58 fitted through holes 59 and 60 formed in the movable plate 21 at the raised portion thereof.

The one hole 59 for the center stud 57 is in axial alignment with the longitudinal slit 22. The center stud 57 is longer than the other stud 58 and is provided with a retractable stop member 61 on its periphery to put the positioning member 55 selectively in a raised position where it is nested in a recess 62 formed in the underside of the movable plate 21 so as not to obstruct the drawing of an ellipse, or in a lowered position where it lies on the paper so as to be rotatable around the center stud 57 with the other stud 58 out of the corresponding hole 60.

When the positioning member 55 is put in the lowered position by retracting the stop member 61 to get the stud 58 out of the hole 60 and is turned 180° around the stud 57, the center mark 56 comes to the intersecting point between the slit 24 and the slit 22.

With the slit 16 in the swivel arm 15 aligned with the slit 23 in the movable plate 21 as in FIG. 1, the intersecting point between the slits 22 and 24 represents the center of an ellipse to be drawn. When the swivel arm 15 is in such a position, the center mark 56 accurately indicates the center of the ellipse.

The distance between the center line of the slit 24 and the center of the hole 59 is equal to that between the center of the stud 57 and that of the center mark 56.

A graduation 63 for determining the length of the major axis of the ellipse is provided on the swivel arm 15 at one side of the slit 16 therealong. On the movable plate 21 are a graduation 64 for registering the ellipse angle and a graduation 65 for indicating the length of the minor axis, along the slit 22 and slit 24, respectively.

It is known that in an ellipse the ratio of the length of minor axis to that of major axis is determined by the sine of an ellipse angle. Thus, the graduations 63, 64 and 65 are provided by use of the trigonometric function as follows.

First, the graduations 63 and 65 are provided to cooperate with a guide line 66 on the adjusting member 33 and a guide line 67 on the slide plate 41, respectively. Then, using the trigonometric function, the graduation 64 for the ellipse angle is determined.

Since sine 30°, for example, is 0.5, the length of the minor axis should be half that of the major axis to draw an ellipse of 30°. Therefore, when the swaying lever 30 is set in such a position that the guide line 66 indicates, e.g., 10 cm while the guide line 67 points to 5 cm, then the guide line 68 on the fulcrum member 25 should indicate an ellipse angle of 30°. This is repeated for other angles to provide the graduation 64 for the ellipse angle.

Around the stepped hole 17 in the base plate 11 is also provided a graduation 69 for division of the angle, said graduation cooperating with a guide line 70 on the swivel arm 15. The graduation 69 has lines each representing 1°. The guide line 70 passes through the swivel center of the swivel arm 15. The ellipse that has been drawn can be precisely divided by means of the graduation 69 and the guide line 70.

The operation of this ellipse drawing instrument will be described below.

The shape of an ellipse is determined either by the length of the major axis and the ellipse angle or by the lengths of the major and minor axes. How to draw an ellipse will be first explained if the length of major axis and the ellipse angle are known.

The fulcrum member 25 is moved along the slit 22 by means of the knob 29 until the guide line 68 indicates the ellipse angle on the graduation 64, and the knob 29 is tightened. The adjusting member 33 is then moved with the knob 37 along the slit 16 in the swivel arm 15 until the guide line 66 registers the predetermined length of the major axis on the graduation 63. Tightening the knob 37 will couple the swivel arm 15 to the swaying lever 30 through the slit 23. This automatically determines the length of the minor axis, too.

Then, the base plate 11 is placed on the paper with the notch 14 disposed at the drawing area thereon. With the slit 16 in the swivel arm 15 aligned with the slit 23 in the movable plate 21 as shown in FIG. 1, the point of intersection between the slit 22 and 24 represents the center of an ellipse to be drawn.

For this centering, the positioning member 55 is used. When said member is lowered onto the paper and turned 180° around the stud 57 with the stud 58 butting against the recess 62, the center mark 56 comes to the aforesaid point of intersection. The base plate 11 is moved until the center mark 56 comes just over the desired ellipse center. The directions of the major and minor axes are now determined.

After centering is complete, the positioning member 55 is raised back to the original position so as not to obstruct the movement of the swaying lever 30. The holder 45 for a writing implement is screwed in the cylindrical member 40 and the writing material 52 is put into pressure contact with the paper.

With the base plate 11 held in position, the swivel arm 15 is given a full turn by use of the knob 37. The movable plate 21 will move in a longitudinal direction while the knob 37 slides up and down the slit 23.

The swaying lever 30 sways around the fulcrum 27 moving longitudinally with the movable plate 21 while its pivoted end makes a full turn with the knob 37. The slit 32 affords to the fulcrum 27 room for longitudinal movement. The movable plate 21 goes leftward for a length equal to the diameter of a circle that the knob 37 draws, and then comes back rightward for the same distance. Said diameter, or the stroke through which the movable plate 21 reciprocates, represents the length of the major axis of the ellipse being drawn.

Mounted so as to be slidable in the slit 24 in the movable plate 21, the writing implement carriage 39 is given a sliding movement by the movable plate 21 and the swaying lever 30 in both longitudinal and transverse directions. This combined movement of the carriage 39 causes the writing implement to draw on the paper an ellipse of the predetermined ellipse angle and length of major axis.

Figure 5:
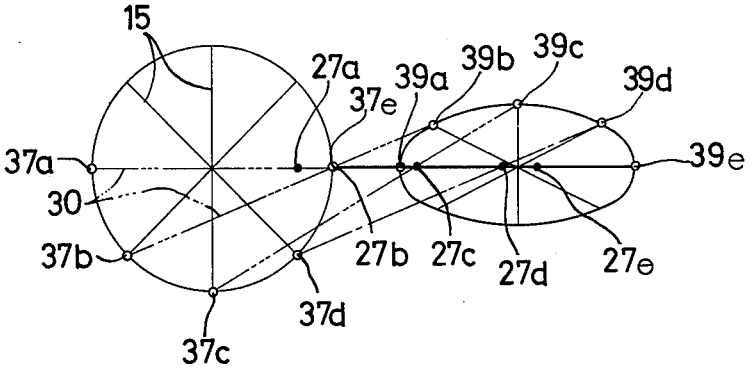
FIG. 5 is an explanatory illustration showing the relationship between a circular movement by the swivel arm and an elliptical movement by the writing implement.

It will be described in more detail with reference to FIG. 5 how the writing implement is given an elliptical movement.

Now assume that the swivel arm 15, slit 22 and swaying lever 30 are aligned with one another with the knob 37 located at **37*a*, the writing implement at 39*a* and the fulcrum at 27*a*. When the swivel arm 15 is turned 45° in a counterclockwise direction in FIG. 5, the knob 37 comes to the position 37*b* while the fulcrum 27 and the writing implement carriage 39 move rightward for a distance equal to the lateral displacement of the movable plate 21. And the writing implement carriage 39 will be on an extension line linking the new knob position 37*b* and the new fulcrum position 27*b***.

Similarly, when the knob 37 is turned in turn to **37*c*, 37*d*, 37*e*, the writing implement carriage 39 moves to points 39*c*, 39*d*, 39*e* where the line passing points 37*c*, 37*d*, 37*e* and points 27*c*, 27*d*, 27*e*, respectively, crosses a vertical line rising from the corresponding positions of the slit 24. This movement of the writing implement carriage 39** enables this instrument to draw an ellipse.

If only the lengths of the major and minor axes are known, the ends of the swaying lever 30 are set at the corresponding positions on the graduations 63 and 65 with the swivel arm 15 aligned with the slit 23 and with the fulcrum member 25 left free. The fulcrum member 25 is then tightened at this position. The rest is the same as described above. Thus, an ellipse can be drawn even if the ellipse angle is unknown.

If it is desired to divide the ellipse thus drawn or mark a particular point on its periphery, the swivel arm 15 is turned until the guide line 70 is aligned with a desired line on the angle graduation 69 and the holder 45 is pressed down to produce a mark or thick portion on the ellipse line for division or marking.

As an additional feature, the graduations 63, 64 and 65 can be utilized to determine the sine values of particular angles. With one end of the swaying lever 30 set at a suitable position on the graduation 63 for major axis, the fulcrum member 25 is moved until the guide line 68 is aligned with the angle, the sine of which is known. The length of the minor axis indicated by the guide line 67 is then read on the graduation 65. The value to be obtained will be determined by dividing the length of the minor axis by that of the major axis.

The instrument according to the present invention can also be used to cut an elliptical hole, groove or the like by mounting a cutting tool instead of a writing implement at the intersection of the slits 24 and 32. Also, templates for drawing ellipses can be easily manufactured by this method.

It will be understood from the foregoing that this invention provides an instrument capable of drawing ellipses easily and precisely without requiring special technique or troublesome calculation. It also provides greater flexibility in the drawing of ellipses because ellipses of a steplessly varying ellipse angle can be drawn with simple adjustment and because ellipses can be drawn even when only the lengths of major and minor axes are known.

The angle graduation 69 provided on the base of the swivel arm is convenient for use in dividing the ellipse drawn or marking any particular position on its periphery.

While the invention has been shown and described with reference to a preferred embodiment, it will be understood by those skilled in the art that other changes in form and details can be made therein without departing from the spirit and scope of the invention.

What is claimed is:

1. An ellipse drawing instrument comprising:

a base plate adapted to be placed on a surface on which an ellipse is to be formed, said base plate having upstanding side walls each having a guide groove therein, a swivel arm rotatably mounted on said base plate and having a longitudinal slit therein, a movable plate mounted above said swivel arm and slidable in said guide grooves so as to be movable in a longitudinal direction, said movable plate having a pair of parallel transverse slits suitably spaced from each other and a single longitudinal slit disposed between said transverse slits substantially midway between the sides of said movable plate, a fulcrum member having a fulcrum at one end thereof mounted on said movable plate at a position adjustable along said longitudinal slit therein, a swaying lever having a hole at one end thereof and a longitudinal slit therein extending from the other end thereof about halfway along its length and mounted between said movable plate and said swivel arm with said fulcrum fitting in said longitudinal slit in the swaying lever so as to be swayable around said fulcrum while moving longitudinally with said movable plate, an adjusting member having a shaft projecting upward from one end thereof, said shaft fitting in said longitudinal slit in the swivel arm, said hole in the swaying lever and said one transverse slit in the movable plate to couple these three members together, said swivel arm having a recess in under side thereof along said slit in which said adjusting member is received to permit adjustment of its position therealong, an ellipse forming implement carriage slidably mounted in said other transverse slit in the movable plate and in said longitudinal slit in the swaying lever, and a positioning member having two studs projecting from the upper face thereof and turnably and removably mounted under said movable plate adjacent to said other transverse slit, said movable plate having two holes therein in which said studs are removably fitted, said positioning member having thereon a center mark to indicate the center position of an ellipse to be drawn at an intersecting point between said other transverse slit and an extension of said longitudinal slit in the movable plate, said swivel arm having thereon a graduation for the length of the major axis of the ellipse and extending in the direction along which the position of said adjusting member is adjustable, and said movable plate having thereon a graduation for the ellipse angle extending along said longitudinal slit therein.

* * * * *